US005924305A

United States Patent [19]

Hill

[11] Patent Number: 5,924,305

[45] Date of Patent: Jul. 20, 1999

[54] THERMODYNAMIC SYSTEM AND PROCESS FOR PRODUCING HEAT, REFRIGERATION, OR WORK

[76] Inventor: Craig Hill, P.O. Box 265, Lincoln, Mass. 01773

[21] Appl. No.: 09/006,697

[22] Filed: Jan. 14, 1998

[51] Int. Cl.[6] ..... F25B 1/00

[52] U.S. Cl. ..... 62/467; 60/671

[58] Field of Search ..... 62/467; 60/671

[56] References Cited

U.S. PATENT DOCUMENTS

| | | | |
|---|---|---|---|
| 1,634,797 | 7/1927 | Newton . | |
| 1,856,048 | 6/1932 | Ahrens . | |
| 2,454,424 | 11/1948 | Baak | 230/11 |
| 2,811,826 | 11/1957 | Alcock | 60/13 |
| 3,988,894 | 11/1976 | Melchior | 60/606 |
| 4,112,683 | 9/1978 | Bess | 60/595 |
| 4,125,999 | 11/1978 | Melchior | 60/606 |
| 4,205,532 | 6/1980 | Brenan | 62/467 |
| 4,233,815 | 11/1980 | Melchior | 60/606 |
| 4,250,711 | 2/1981 | Zehnder | 60/605 |
| 4,267,692 | 5/1981 | Earnest | 60/39.18 R |
| 4,269,040 | 5/1981 | Grundmann et al. | 62/467 |
| 4,350,013 | 9/1982 | Yoshiba | 60/605 |
| 4,373,336 | 2/1983 | Hörler et al. | 60/606 |
| 4,445,488 | 5/1984 | Tanaka et al. | 123/569 |
| 4,462,376 | 7/1984 | Ripper et al. | 123/571 |
| 4,513,571 | 4/1985 | Jenny et al. | 60/603 |
| 4,561,253 | 12/1985 | Curtil | 60/606 |
| 4,693,090 | 9/1987 | Blackman | 62/467 |
| 4,745,752 | 5/1988 | Suzuki | 60/602 |
| 4,779,427 | 10/1988 | Rowley et al. | 62/116 |
| 4,785,635 | 11/1988 | Melchior et al. | 60/606 |
| 4,823,560 | 4/1989 | Rowley et al. | 62/467 |
| 4,833,886 | 5/1989 | Meier | 60/602 |
| 4,873,825 | 10/1989 | Jenes | 60/606 |
| 4,876,856 | 10/1989 | Iishiki et al. | 60/671 |
| 4,916,903 | 4/1990 | Holmér | 60/605.1 |
| 4,932,372 | 6/1990 | Meneely | 123/182 |
| 4,942,860 | 7/1990 | Chujo et al. | 123/571 |
| 4,984,432 | 1/1991 | Corey | 62/467 |
| 5,050,384 | 9/1991 | Crockett | 60/605 |
| 5,203,311 | 4/1993 | Hitomi et al. | 123/570 |
| 5,228,415 | 7/1993 | Williams | 123/51 R |
| 5,418,399 | 5/1995 | Klaue | 290/1 R |
| 5,477,840 | 12/1995 | Neumann | 123/564 |
| 5,557,919 | 9/1996 | Althaus | 60/39.06 |
| 5,622,053 | 4/1997 | Freen | 60/603 |

*Primary Examiner*—Ronald Capossela
*Attorney, Agent, or Firm*—Lahive & Cockfield, LLP

[57] ABSTRACT

An external combustion thermodynamic system includes a compression stage for substantially adiabatically compressing a working medium to raise the temperature of the medium and an expansion stage for substantially adiabatically expanding the medium to decrease the temperature of the medium. A first heat exchanger is coupled to the compression stage and the expansion stage to allow the expanded medium to pass therebetween and is structured to transfer heat substantially isochoricly (i.e., at constant volume) between the cold reservoir and the expanded medium. A second heat exchanger is coupled to the compression stage and the expansion stage to allow the compressed medium to pass therebetween. The second heat exchanger is structured to transfer heat substantially isochoricly between the compressed medium and the hot reservoir. The thermodynamic system also includes a recuperative heat exchange loop for transferring heat between the expanded medium within the first heat exchanger and the compressed medium within the second heat exchanger. The thermodynamic system approaches the thermal efficiency of a Stirling engine without the need for a regenerator.

34 Claims, 5 Drawing Sheets

THERMODYNAMIC SYSTEM AND PROCESS FOR PRODUCING HEAT, REFRIGERATION, OR WORK

BACKGROUND OF THE INVENTION

The present invention relates generally to thermodynamic machines and processes for producing heating, refrigeration, or work from thermal energy. More particularly, the invention relates to a piston machine operable as a heat pump, a refrigerator, or a heat engine.

The transformation of heat into work is typically accomplished by two general types of engine: the external heat source engine, such as the steam engine, and the internal heat source engine, such as the gasoline engine and the diesel engine. In both types of engines, a working medium, such as a vapor or a gas or a mixture of gases contained in a cylinder, undergoes a cycle, thereby causing a piston to impart to a shaft a motion of rotation against an opposing force. It is necessary in both types of engines that, at some time in the cycle, the vapor or gas in the cylinder be raised to a high temperature and pressure. In the external heat source engine this is accomplished by an outside heat source, such as a boiler. External heat source engines are of two general types; condensing cycle engines, such as the steam engine, and non-condensing cycle engines.

One of the earliest developed non-condensing, external heat source engines is the Stirling engine, a hot-air engine that converts some of the energy liberated by burning fuel into work. An ideal Stirling engine runs on the Stirling cycle, which is characterized by constant temperature (isothermal) expansion and compression and constant volume (isochoric) heating and cooling. A typical Stirling engine includes two pistons, an expansion piston and a compression piston, connected to the same shaft. As the shaft rotates, the pistons move in different phase, with the aid of suitable connecting linkages. The space between the two pistons is filled with a working medium, typically air, helium, or hydrogen. The expansion piston is kept in contact with a hot reservoir (i.e., burning fuel), while the compression piston is in contact with a cold reservoir. A regenerator is positioned between the two pistons. The regenerator is constructed to have a thermal conductivity low enough to support the temperature difference between the hot and cold reservoirs without appreciable heat conduction.

Recently, there has been renewed interest in developing Stirling cycle engines. This is due to the high theoretical thermal efficiency that can be attained with a Stirling cycle engine. With perfect (100%) regeneration, the ideal Stirling cycle engine has Carnot cycle efficiency ($1-T_c/T_h$). Stirling cycle engines have been constructed using ceramic materials on the hot side of the engine to allow the engine to achieve over 40% thermal efficiency. Furthermore, the external combustion process allows the use of a wide variety of combustible or renewable (i.e., solar) fuels. Also, Stirling cycle engines are generally quieter and produce lower emissions than conventional internal combustion engines.

A further advantage of the Stirling cycle engine is that the engine is a reversible device. This allows the Stirling engine to be operated in a refrigeration or heat pump cycle in which net work is done on the engine and heat is accepted at a low temperature and rejected at a high temperature. When the engine is used as a refrigeration or cooling device, the useful heat is the heat accepted at the low temperature. Conversely, when the engine is used as a heating device the useful heat is the heat that is rejected at the higher temperature.

In a conventional refrigerator or heat pump, a compressor delivers gas, known as the refrigerant, at a high temperature and pressure to condensing coils. Heat is removed from the gas by cooling, resulting in condensation of the gas to a liquid still under high pressure. The liquid passes through a throttling or expansion valve, emerging as a mixture of liquid and vapor at a much lower temperature. Heat is supplied to the gas in an evaporation coil that converts the remaining liquid into vapor which enters the compressor to repeat the cycle. One of the problems associated with conventional refrigerators is the need for a refrigerant that releases a large amount of latent heat in relation to its volume when undergoing a change of state. Such refrigerants can be expensive to manufacture and can be harmful to the environment.

As a heating/cooling device, the Stirling engine offers advantages over devices that operate according to a condensing cycle, such as the conventional refrigerator. By avoiding changes of state and inevitable thermodynamic losses due to the throttling process in conventional refrigeration or heat pump cycles, and by incorporating a regenerator that recycles heat energy that would otherwise be lost, a Stirling cycle offers significant theoretical advantages over those systems in energy consumption, and superior coefficients of performance in operation. Additionally, the Stirling cycle does not necessitate the use of conventional refrigerants.

One of the limitations associated with Stirling cycle engines is that the engine is practically limited to equivalent compression and expansion ratios of 2.5 or less and thus requires high pressurization of the working medium to attain sufficient mass flow for practical work output, greatly complicating engine mechanical design. The Stirling engine also relies heavily upon the ability of the regenerator to store heat during the constant volume phases of the Stirling cycle in order to reach maximum thermal efficiency. Such high efficiency regenerators can be difficult and expensive to manufacture and introduce additional flow losses which reduce the practically achievable efficiency to a fraction of theoretical values.

Accordingly, there is a need for an external heat source, non-condensing thermodynamic system having a thermal efficiency approaching the theoretical thermal efficiency of the Stirling engine while concomitantly avoiding the high pressurization required by low compression/expansion ratios and the frictional flow losses through the Stirling regenerator.

An object of the present invention is to provide an improved thermodynamic system that is capable of operating as a heat engine, a refrigerator, or a heat pump with high thermal efficiency.

Another object of the present invention is to provide a thermodynamic system that can operate as a thermally efficient heating or cooling device without the need for expensive or environmentally harmful refrigerants.

Still another object of the present invention is to provide a thermodynamic system that can operate as a thermally efficient heating or cooling device by incorporating a cyclic recuperator with minimal flow losses and high heat recycling efficiency.

Other general and more specific objects of this invention will in part be obvious and will in part be evident from the drawings and the description which follow.

SUMMARY OF THE INVENTION

These and other objects are attained by the thermodynamic system of the present invention which includes a compression stage for substantially adiabatically compressing a working medium to raise the temperature of the medium and an expansion stage for substantially adiabatically expanding the medium to decrease the temperature of the medium. A first external heat exchanger is coupled to the expansion stage and the compression stage to allow the expanded medium to pass therebetween and is structured to transfer heat substantially isochoricly (i.e. at constant volume) between a low temperature external heat reservoir and the expanded medium.

A second external heat exchanger is coupled to the compression stage and the expansion stage to allow the compressed medium to pass therebetween. The second heat exchanger is structured to transfer heat substantially isochoricly between the compressed medium and a high temperature external heat reservoir.

The thermodynamic system of the present invention offers the advantage of being operable as refrigerator for transferring heat from a cold reservoir to a hot reservoir to cool the cold reservoir, as a heat pump for transferring heat from a cold reservoir to a hot reservoir to heat the hot reservoir, or as a heat engine for converting heat from a hot reservoir to mechanical energy, while concomitantly maintaining high thermal efficiency for each mode of operation.

The thermodynamic system preferably can also include a recuperative heat exchange loop for transferring heat between the expanded medium within the first heat exchanger and the compressed medium within the second heat exchanger. The recuperative heat exchange loop allows for the recycling of heat between the compressed medium within the second heat exchanger and the expanded medium within the first heat exchanger. A first recuperative heat exchange conduit of the recuperative heat exchange loop connects the first heat exchanger and the second heat exchanger and is structured to recycle heat substantially isochoricly between the expanded medium and the compressed medium. A second conduit of the recuperative heat exchange loop additionally connects the first heat exchanger and the second heat exchanger and is structured to complete the recuperative loop by transferring heat substantially isochoricly between the compressed medium and the expanded medium. By incorporating a heat recuperator as an integral component, the thermodynamic system of the present invention provides a thermal efficiency approaching the thermal efficiency of the Stirling engine without requiring high operating pressures or the fluid flow losses through a regenerator that can greatly reduce the attainable efficiencies of Stirling machines.

Furthermore, the working medium of the thermodynamic system of the present invention does not change states during the working cycle of the system. This eliminates the inherent loss in thermodynamic efficiency from a throttling valve required in conventional refrigerator/heat pump systems. Additionally, the thermodynamic system of the present invention can operate with air, hydrogen, or helium as the working medium rather than the expensive or environmentally harmful refrigerants used in conventional refrigeration/heat pump systems.

When operating as a refrigerator, the thermodynamic system of the present invention, including the first external heat exchanger, can be structured to transfer heat substantially isochoricly from the low temperature reservoir to the expanded medium to cool the low temperature reservoir, heating the expanded medium. In addition, the system, including the second external heat exchanger, can also be structured to transfer heat substantially isochoricly from the compressed medium to an external higher temperature reservoir to heat that reservoir and cool the compressed medium.

When operating as a heat pump, the thermodynamic system of the present invention, including the first external heat exchanger, can be structured to transfer heat substantially isochoricly from an external low temperature reservoir to the expanded medium to heat the expanded medium. In addition, the system, including the second heat exchanger means, can be structured to transfer heat substantially isochoricly from the compressed medium to an external hot reservoir to heat the hot reservoir.

When operating as a prime mover heat engine, the thermodynamic system of the present invention, including the first heat exchanger, can be structured to transfer heat substantially isochoricly from the expanded medium to a cold reservoir to cool the expanded medium. In addition, the system, including the second heat exchanger, can be structured to transfer heat substantially isochoricly from a high temperature reservoir to the compressed medium to heat the compressed medium. The subsequent expansion of the heated, compressed medium produces positive mechanical work.

The compression stage of the thermodynamic system of the present invention can optionally include a first cylinder having a first volume, a second cylinder having a second volume less than the first volume, and a piston or the like for displacing the medium from the first cylinder to the second cylinder to compress the medium substantially adiabatically.

The expansion stage of the thermodynamic system of the present invention can optionally include a first cylinder having a first volume, a second cylinder having a second volume greater than the first volume, and a piston or the like for displacing the medium from the first cylinder to the second cylinder to expand the medium substantially adiabatically.

The thermodynamic system can also optionally include an auxiliary pressurizing device, such as a pump, compressor, or the like, connected to the second heat exchanger to pressurize the second heat exchanger to a preferred operating working medium density prior to passage of the compressed medium through the second heat exchanger. Preferably, the preferred operating working medium density is substantially equal to the density of the compressed medium entering the second heat exchanger from the compression stage.

Likewise, the thermodynamic system can also optionally include an auxiliary pressurizing device, such as a pump, compressor, or the like, connected to the first heat exchanger, to pressurize the first heat exchanger to a preferred operating pressure prior to passage of the expanded medium through the first heat exchanger. Preferably, the preferred operating working medium density is substantially equal to the density of the compressed medium entering the first heat exchange means from the expansion stage.

In accordance with an alternative embodiment of the present invention, the thermodynamic system includes a first chamber defining a first volume and a second chamber defining a second volume less than the first volume. A first piston is operatively positioned with the first chamber to displace the medium from the first volume to the second volume and compress the medium substantially adiabatically. A second piston is operatively positioned within the second chamber to displace the medium from the second volume to the first volume and expand the medium substantially adiabatically. The thermodynamic system also includes a first heat exchanger coupled to the second chamber for substantially isochoricly transferring heat between a hot reservoir and the medium after compression by the first piston and a second heat exchanger coupled to the first chamber for substantially isochoricly transferring heat between a cold reservoir and the medium after expansion by the second piston.

BRIEF DESCRIPTION OF THE DRAWINGS

These and other features and advantages of the present invention will be more fully understood by reference to the following detailed description in conjunction with the attached drawings in which like reference numerals a refer to like elements through the different views. The drawings illustrate principals of the invention and, although not to scale, show relative dimensions.

DESCRIPTION OF THE ILLUSTRATED EMBODIMENTS

Figure 1:
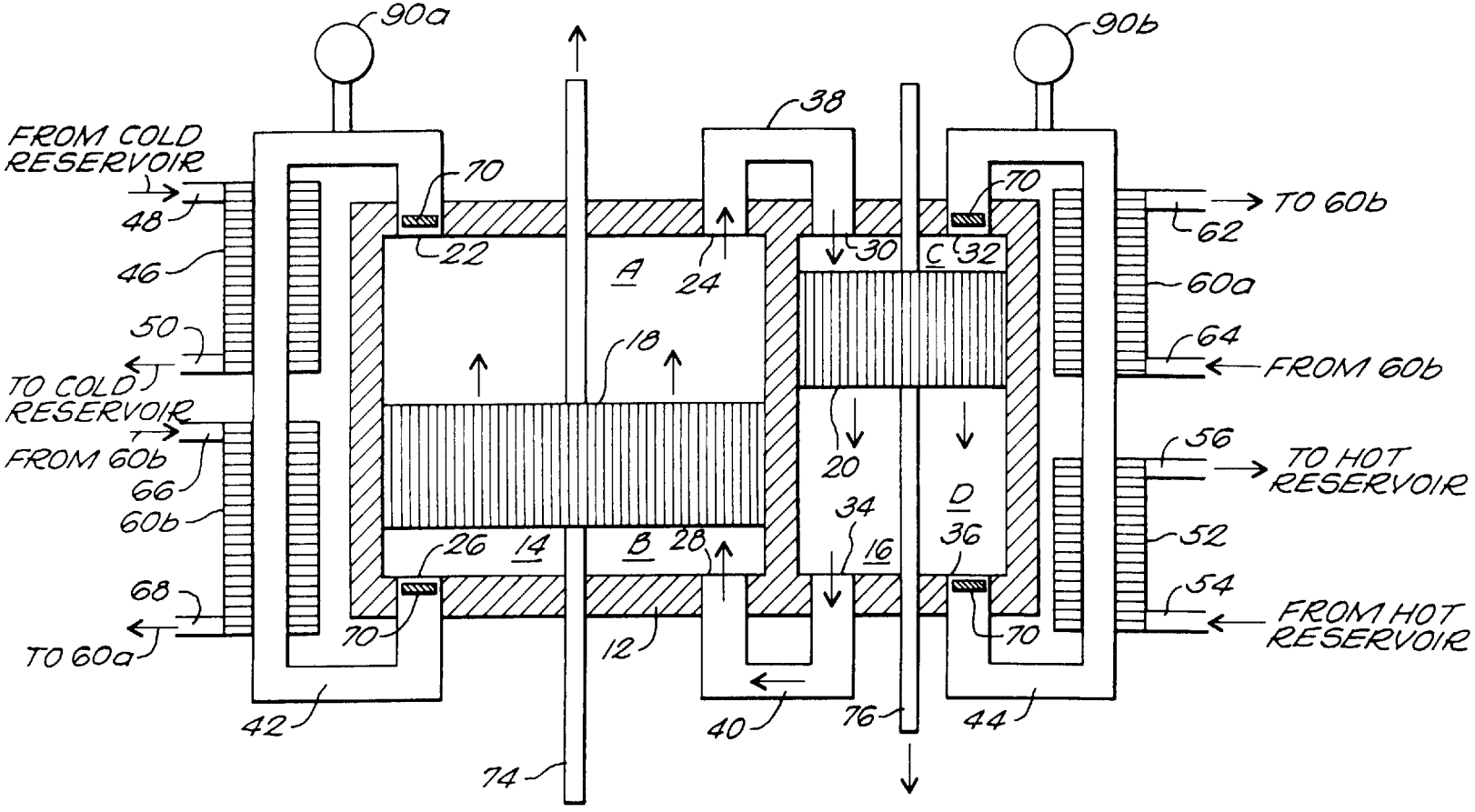
FIG. 1 is a side elevational, partially schematic view in cross section of a first embodiment of the thermodynamic system, illustrating simultaneous adiabatic compression and expansion according to the teachings of the present invention.
Figure 2:
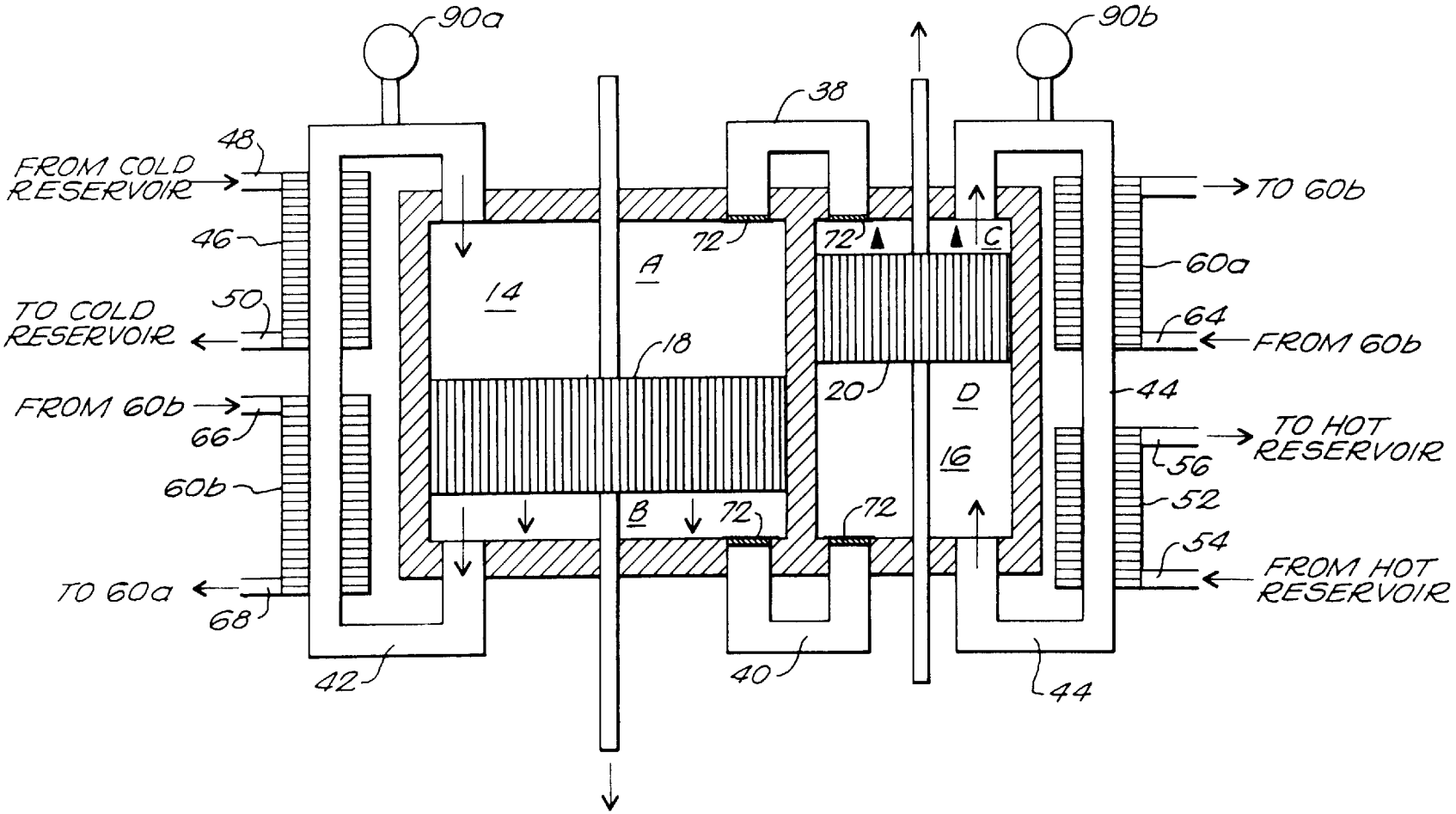
FIG. 2 is a side elevational, partially schematic view in cross section of the thermodynamic system of FIG. 1, illustrating constant volume heat transfer according to the teachings of the present invention.

A thermodynamic system 10 in accordance with a first embodiment of the invention and which is operable as either a heat pump system, a refrigeration system, or a heat engine is illustrated in FIGS. 1 and 2. The thermodynamic system includes a housing 12 which is divided into a larger volume first cylinder 14 and a smaller volume second cylinder 16. The first cylinder 14 houses a first piston 18 which is operable to reciprocate within the first cylinder 14 and, thus, divides the cylinder 14 into two chambers A and B of variable volume. Likewise, the second cylinder 16 houses a second piston 20 which is operable to reciprocate within the second cylinder 16 and, thus, divides the cylinder 16 into two chambers C and D of variable volume.

As used herein, the terms "heat pump" and "heat pump system" refers to devices or systems which operate to transfer heat from a cooler reservoir to a hotter one, expending mechanical energy in the process, for the primary purpose of heating the hotter reservoir. Likewise, as used herein, the terms "refrigerator" and "refrigeration system" refer to devices or systems which operate to transfer heat from a cooler reservoir to a hotter one, expending mechanical energy in the process, for the primary purpose of cooling the cooler reservoir. As used herein, the term "heat engine" refers to devices which operate to convert heat from a hot reservoir into mechanical energy.

A working medium is provided within the housing 12 of the thermodynamic system 10. The working medium is preferably a gas or a mixture of gases. Suitable gas or gas mixtures include air, hydrogen, and helium. During operation of the thermodynamic system 10, the working medium undergoes a closed thermodynamic cycle in which the working medium is substantially adiabatically compressed to increase the temperature of the medium, heated or cooled at constant volume (isochoricly), substantially adiabatically expanded to decrease the temperature of the medium, and cooled or heated at constant volume (isochoricly), to return the working medium to its initial pressure and temperature.

The first cylinder includes four openings, first opening 22, second opening 24, third opening 26, and fourth opening 28. Likewise, the second cylinder 16 includes four openings, first opening 30, second opening 32, third opening 34, and fourth opening 36. Two fluid conduits provide fluid communication between the first cylinder 14 and the second cylinder 16. The first connecting conduit 38 connects the second opening 24 of the first cylinder 14 to the first opening 30 of the second cylinder 16. A second connecting conduit 40 connects the third opening 34 of the second cylinder 16 to the fourth opening 28 of the first cylinder 14. Accordingly, the first and second connecting conduits 38, 40 allow the working medium to be displaced between the first cylinder 14 and the second cylinder 16.

A first heat exchanging conduit 42 connects the first opening 22 and the second opening 26 of the first cylinder 14. Likewise, a second heat exchanging conduit 44 connects the second opening 32 and the fourth opening 36 of the second cylinder 16. The first and second fluid conduits 42, 44 facilitate constant volume heat transfer to and from the working medium.

A first heat exchanger 46 is provided about the first heat exchanging conduit 42 proximate first opening 22 of the first cylinder 14. A suitable heat transfer medium, such as water or air, circulates through the first heat exchanger 46 and a cold reservoir through input 48 and output 50. The first heat exchanger 46 provides for heat transfer, through the heat transfer medium, between the cold reservoir and the working medium, as the working medium is displaced at constant volume through the first heat exchanging conduit 42.

A second heat exchanger 52 is provided about the second heat exchanging conduit 44 proximate the fourth opening 36 of the second cylinder 16. A heat transfer medium, such as water or air, circulates between a hot reservoir and the second heat exchanger 52 through input 54 and output 56. The second heat exchanger 52 provides for heat transfer between the working medium displaced at constant volume through the second heat exchanging conduit 44 and the hot reservoir by means of the heat transfer medium circulating through the heat exchanger.

A recuperative heat exchanger system including a first heat exchanger section 60*a* and a second heat exchanger section 60*b* can be provided to transfer heat between the working medium in the second heat exchanging conduit 44 and the working medium in the first heat exchanging conduit 42. The first heat exchanger section 60*a* is arranged about the second heat exchanging conduit 44 proximate the second opening 32 of the second cylinder 16, and includes input 64 and output 62. The second heat exchanger section 60*b* is arranged about the first heat exchanging conduit 42 proximate the third opening 26 of the first cylinder 14 and includes input 66 and output 68.

As the working medium passes through second heat exchanging conduit 44 at constant volume, heat is transferred between the working medium and heat transfer medium within the first heat exchanger section 60*a*. Likewise, heat is transferred between the working medium conveyed at constant volume through first heat exchanging conduit 42 and the heat transfer medium within second heat exchanger section 60*b*. The heat transfer medium circulates between first heat exchanger section 60*a* and second heat exchanger section 60*b*, as the output 62 of heat exchanger section 60*a* connects to the input 66 of heat exchanger section 60*b* and the output 68 of heat exchanger section 60*b* connects to the input 64 of heat exchanger section 60*a*. Thus, the first heat exchanger section 60*a* and the second heat exchanger section 60*b* operate to allow heat to be efficiently transferred between the working medium within the first heat exchanging conduit 42 and the working medium within the second heat exchanging conduit 44. In this manner, heat generated during the cyclical operation of the thermodynamic system 10 can be recycled throughout the system to further increase the overall efficiency of the system 10. A pump (not shown) can be included in the recuperative heat exchanger system to circulate the heat transfer medium through the heat exchanger sections 60*a* and 60*b*.

Continuing to refer to FIG. 1 and FIG. 2, valves are provided at each of the openings to the first cylinder 14 and the second cylinder 16. As illustrated in FIG. 1, valves 70 are provided at the first opening 22 and the third opening 26 to control the displacement of the working medium between chamber A and chamber B of the first cylinder 14 through the first heat exchanger conduit 42. Likewise, valves 70 are also provided at openings 32 and 36 of the second cylinder 16 to control the displacement of the working medium between chamber C and chamber D of the second cylinder 16 through the second heat exchanger conduit 44. As illustrated in FIG. 2, valves 72 are provided at second opening 24 and fourth opening 28 of the first cylinder 14 and first opening 30 and third opening 34 of the second cylinder 16 to control fluid flow between the first cylinder 14 and the second cylinder 16 through first fluid conduit 38 and second fluid conduit 40, respectively. Valves 70 and 72 can be any conventional valve suitable for controlling fluid flow. The operation of the valves 70 and 72 can be controlled through conventional techniques known in the art, such as through mechanical linkages or through electronic or magnetic actuators. While two valves are shown for each conduit, one skilled in the art will recognize that the a single valve in each conduit is sufficient for controlling fluid flow through the conduits.

Rods 74 and 76 are provided within cylinders 14 and 16 to guide the travel of piston 18 and 20, respectively, within the cylinders. The guide rods 74 and 76 are connected to a common crankshaft (not shown) by suitable connecting linkages. The crankshaft can be in turn optionally connected to a flywheel (not shown) which can be mechanically coupled to an engine or other suitable mechanical energy device. Rods 74 and 76 are coupled to the crankshaft in a manner that permits first piston 18 to reciprocate out-of-phase with second piston 20 as the crankshaft is rotated. Preferably, the first piston 18 is approximately 180° out of phase with the second piston 20.

Figure 3:
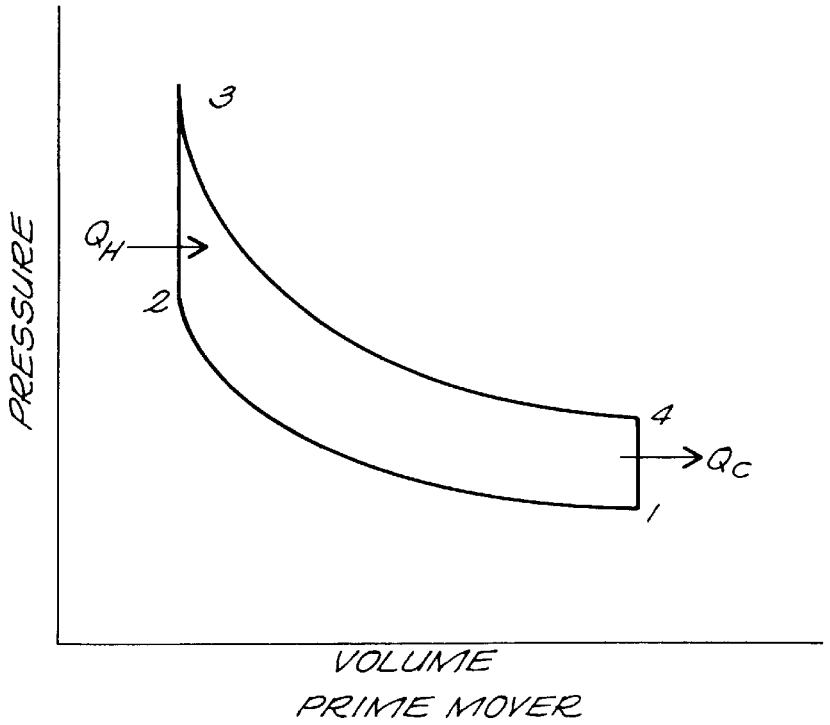
FIG. 3 is a pressure-volume diagram illustrating the operation of the thermodynamic system of the present invention as a heat engine.

The operation of the thermodynamic system 10 as a heat engine or prime mover will be described with reference to FIGS. 1, 2 and 3. FIG. 3 is a pressure volume diagram illustrating the thermodynamic cycle of operation of the thermodynamic system 10 as a prime mover or heat engine under theoretically ideal conditions. With reference to FIG. 3, the thermodynamic cycle includes the steps of (a) substantially adiabatic compression (point 1 to point 2); (b) constant volume heat transfer (point 2 to point 3 ) in which a quantity of heat $Q_H$ from the hot reservoir is absorbed by the working medium; (c) substantially adiabatic expansion (point 3 to point 4); and (d) constant volume heat transfer in which a quantity of heat $Q_C$ leaves the working medium (point 4 to point 1). When operating as a heat engine, the thermodynamic system 10 converts the heat $Q_H$ from the hot reservoir to mechanical energy, i.e., reciprocating motion of the piston 18 and 20 and the resultant rotation of the crankshaft.

During the step of adiabatic compression, valves 72 are opened and valves 70 are closed to allow the working medium to be displaced from the first cylinder 14 into the second cylinder 16, as illustrated in FIG. 1. The first piston 18 moves from the bottom-dead-center (BDC) position to the top-dead-center (TDC) position while the second piston 20 moves from the TDC position to the BDC position. In this manner, the volume of chamber A is decreased and the volume of chamber C is concurrently increased. The working medium is displaced through first connecting conduit 38 from chamber A to smaller volume chamber C to compress the working fluid. This compression occurs substantially adiabatically, i.e., without significant heat loss. During the compression phase, the temperature of the working medium is accordingly increased.

The step of substantially adiabatic expansion occurs simultaneously with the step of substantially adiabatic compression. Movement of the second piston 20 from the TDC position to the BDC position decreases the volume of chamber D. Likewise, movement of the first piston 18 from the BDC position to the TDC position increases the volume of chamber B. The working medium is displaced by the pistons from chamber D into the larger volume of chamber B, substantially adiabatically expanding the working medium. During the expansion phase, the temperature of the working medium is accordingly decreased.

During the steps of constant volume heat transfer, the valves 70 are opened and the valves 72 are closed, as illustrated in FIG. 2. First piston 18 moves from the TDC position to the BDC position, displacing the expanded working fluid within chamber B through the first heat exchanging conduit 42 into chamber A at constant volume. Second piston 20 moves from the BDC position to the TDC position, displacing the working medium from chamber C through second heat exchanging conduit 44 into chamber D at constant volume. The steps of constant volume heat transfer preferably occur concurrently.

As the working medium is displaced through second heat exchanger section 60*b* within the first heat exchanging conduit 42, heat is transferred isochoricly from the working medium to the heat transfer medium of the recuperative heat exchanger. This results in cooling of the working medium and a corresponding decrease in the pressure of the medium. An additional quantity of heat $Q_C$ is transferred isochoricly from the working medium at first heat exchanger 46 to further cool the working medium prior to entry to chamber A.

As the working medium passes through first heat exchanger section 60*a* within second heat exchanging conduit 44, heat is transferred isochoricly from the heat transfer medium to the working medium. This results in heating of the working medium and a corresponding increase of the pressure of the medium. An additional quantity of heat $Q_H$ from an external high temperature source is transferred isochoricly to the working medium at heat exchanger 52 to further heat and increase the pressure of the medium.

The power stroke of the thermodynamic system 10 during the heat engine cycle occurs when the compressed, hot working medium expands from chamber D to chamber B, forcing first piston 18 from the BDC position to the TDC position.

A significant advantage of the thermodynamic system 10 of the present invention is that the system allows construction of embodiments that can be operated in a refrigeration or heat pump cycle in which net work is done on the system 10 or, alternatively, operated as a prime mover to convert heat energy to positive work. In a heat pump or refrigeration device, heat $Q_C$ is accepted at a lower temperature from the cold reservoir and heat $Q_H$ is rejected at a higher temperature to the hot reservoir. When the system 10 is used as a refrigeration or cooling device, the useful heat is the heat $Q_C$ accepted at the low temperature. Conversely, When the system 10 is used a heating device the useful heat is the heat $Q_H$ that is rejected at the higher temperature.

Figure 4:
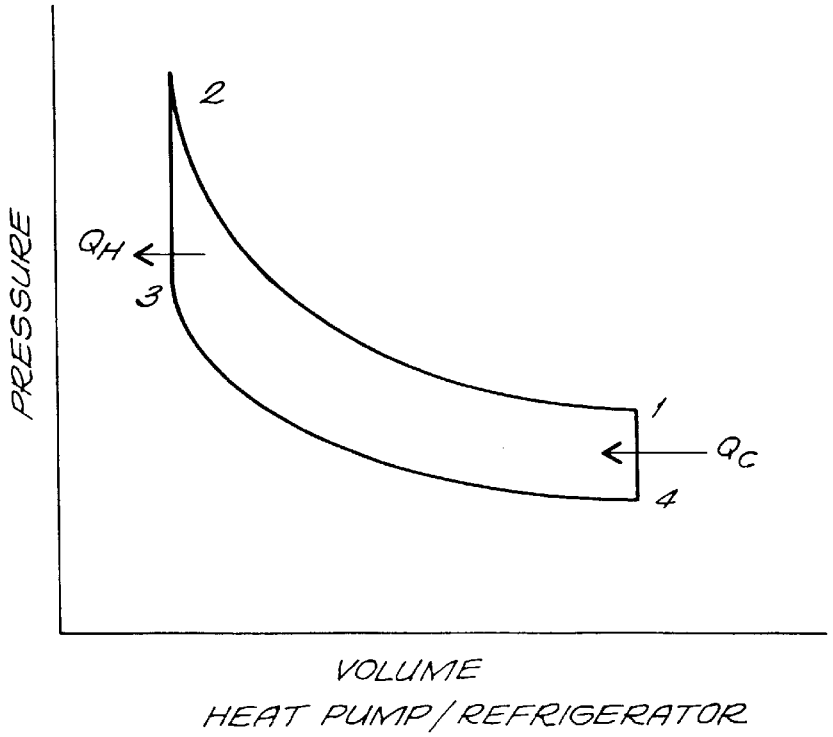
FIG. 4 is a pressure-volume diagram illustrating the operation of the thermodynamic system of the present invention as a heat pump or refrigeration system.

The operation of the thermodynamic system 10 as a heat pump/refrigeration system will be described with reference to FIGS. 1, 2 and 4. FIG. 4 is a pressure volume diagram illustrating the thermodynamic cycle of operation of the thermodynamic system 10 as a heat pump or refrigeration system under theoretically ideal conditions. With reference to FIG. 4, the thermodynamic cycle includes the steps of (a) substantially adiabatic compression (point 1 to point 2); (b) constant volume heat transfer (point 2 to point 3) in which a quantity of heat $Q_H$ is removed from the working medium; (c) substantially adiabatic expansion (point 3 to point 4); and (d) constant volume heat transfer in which a quantity of heat $Q_C$ is absorbed by the working medium (point 4 to point 1). When operating as a heat pump or refrigerator system, net work is input to the system the system 10 (by rotation of the crankshaft) and a quantity of heat $Q_C$ is absorbed from the cold reservoir and a quantity of heat $Q_H$ is rejected to the hot reservoir.

When the thermodynamic system of the present invention is operated as heat pump or refrigeration cycle, it is preferable that the position of the first heat exchanger 46 and the second heat exchanger section 60*b* be reversed to maximize the efficiency of the system 10. Specifically, the first heat exchanger 46 can be positioned proximate the third opening 26 and the second heat exchanging section 60*b* can be positioned proximate the first opening 22 of the first cylinder 14. Likewise, it is preferable that the position of the second heat exchanger 52 and the first heat exchanger section 60*a* also be reversed, i.e., the second heat exchanger 52 positioned proximate the second opening 32 and the first heat exchanger section 60 a positioned proximate the fourth opening 36 of the second cylinder 16.

The manner of operation of the thermodynamic system 10 as a heat pump or refrigeration system is analogous to the operation of the heat engine. Mechanical energy, i.e., the rotation of the crankshaft, causes the first piston 18 to substantially adiabatically compress the working medium from chamber A to smaller volume chamber C. This results in raising the temperature of the working medium. Concurrently, displacement of the working medium from chamber D to larger volume chamber B by piston 20 results in the expansion of the working medium and a corresponding lowering of the medium's temperature.

During the constant volume heat transfer steps, a quantity of heat $Q_H$ heat is transferred isochoricly from the working medium at the second heat exchanger 52 resulting in the heating of the hot reservoir. An additional quantity of heat is removed isochoricly from the working medium at first recuperative heat exchanger section 60*a*. Concurrently, a quantity of heat $Q_C$ is transferred isochoricly to the working medium at first heat exchanger 46 resulting in the cooling of the cold reservoir. Additional heat is transferred isochoricly to the working medium at second recuperative heat exchanger section 60*b*.

The thermodynamic system 10 of the present invention can also include an auxiliary pressurizing system 90 coupled to the first and second heat exchanging conduits 42 and 44. The auxiliary pressurizing system can include two pressure regulating units 90*a* and 90*b*, such as a conventional pump or compressor. The pressure regulating unit 90*a* operates to pressurize the first heat exchanging conduit 42 to an operating working medium density substantially equal to the density of the working medium after the step of substantially adiabatic expansion. Likewise, the pressure regulating unit 90*b* operates to pressurize the second heat exchanging conduit 44 to an operating density substantially equal to the density of the working medium after the step of substantially adiabatic compression.

One skilled in the art will recognize that the rate of output, whether positive work by an engine or heat transfer by a heat pump or refrigeration device, can be readily controlled by increasing or decreasing the mass of the working medium in the system. For this purpose, either pressure regulating unit 90*a* or 90*b* can be coupled to a reservoir of working medium from which the working medium can be added to the system or withdrawn from the system during operation.

The advantage of the auxiliary pressurizing system 90 is that the total mass of the working medium input into the heat exchanging conduits 42 and 44 is substantially equal to the total mass of the working medium output the conduits 42 and 44. This allows the heat exchangers 46 and 52 to be designed independent of the volume/cycle of the working medium transferred through the conduits 42 and 44. Thus, the volume of the working medium within each of the conduits 42 and 44 can be several times the volume/cycle of the working medium, without compromising the mass flow rate. This allows the ability to increase the time of residence of the working medium in each of the conduits 42 and 44, as well as the surface area of the heat exchangers 46 and 52, resulting in highly efficient heat transfer.

Figure 5:
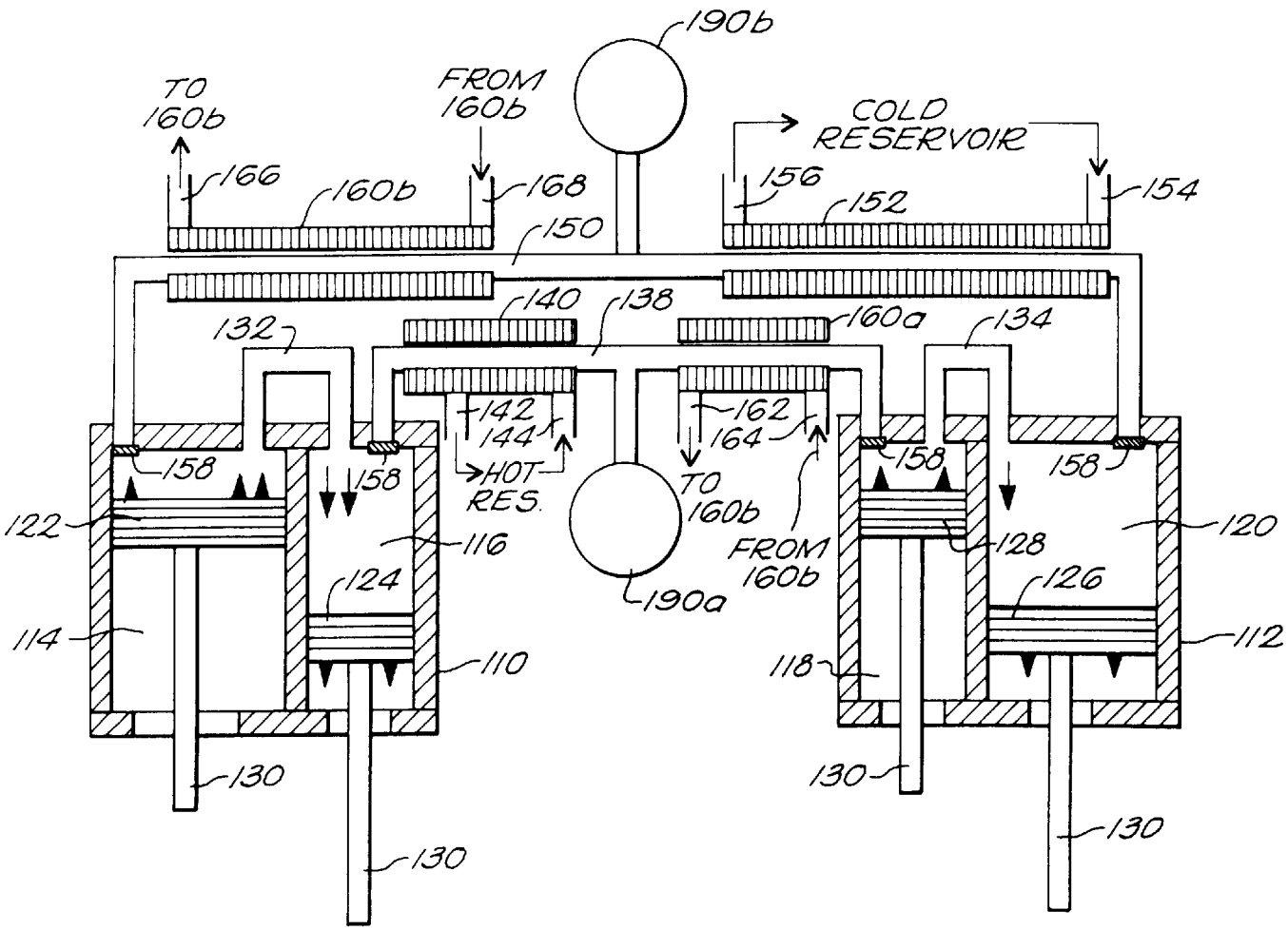
FIG. 5 is a side elevational, partially schematic view in cross section of a second embodiment of the thermodynamic system illustrating simultaneous adiabatic compression and expression according to the teachings of the present invention.
Figure 6:
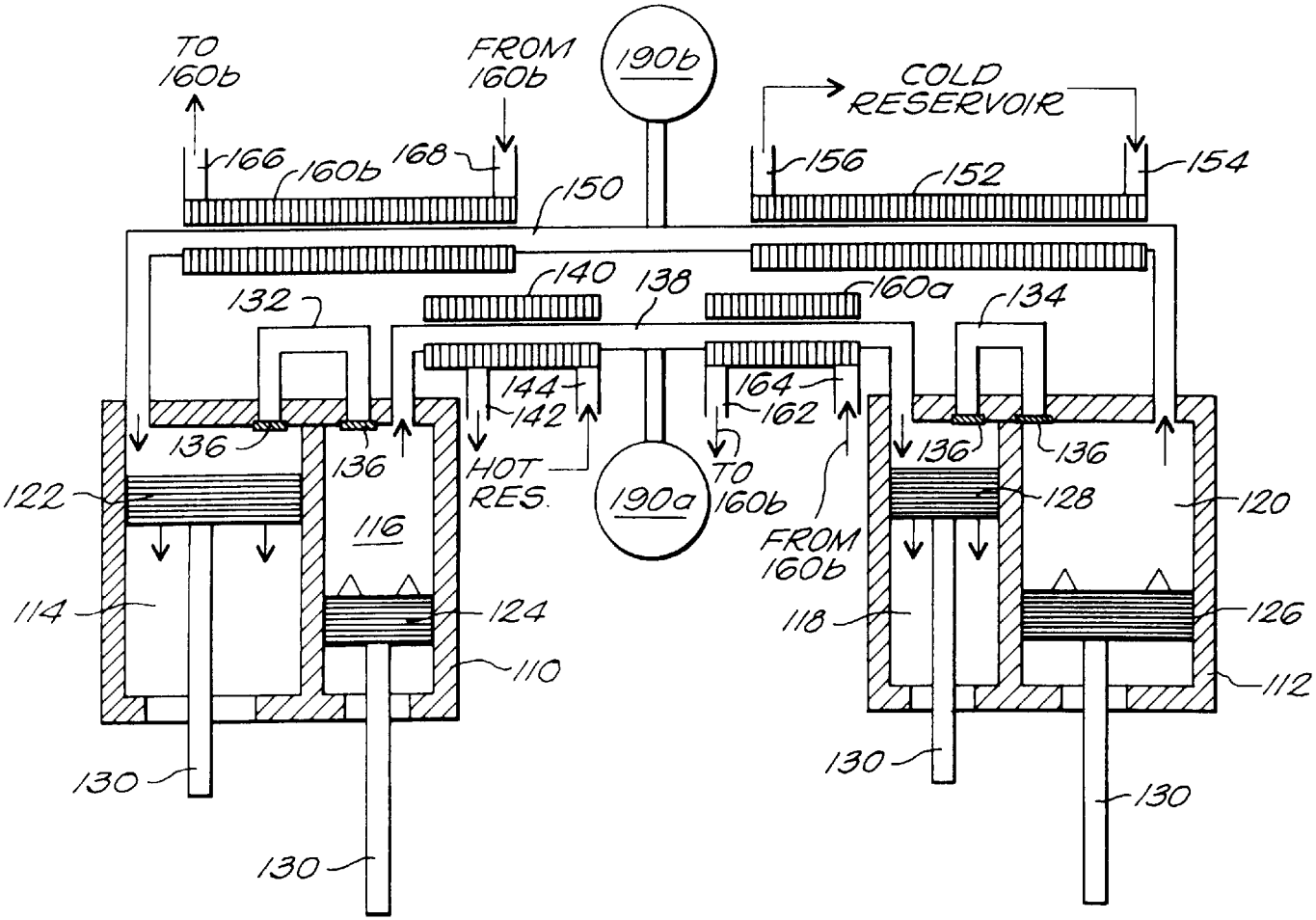
FIG. 6 is a side elevational, partially schematic view in cross section of the thermodynamic system of FIG. 2, illustrating constant volume heat transfer according to the teachings of the present invention.

The second embodiment of the thermodynamic system 10 of the present invention is illustrated in FIGS. 5 and 6. Thermodynamic system 10, in accordance with the second embodiment, includes a compression stage 10 and an expansion stage 112. The compression stage 110 includes a larger volume first cylinder 114 and a smaller volume second cylinder 116. Likewise, the expansion stage includes a smaller volume first cylinder 118 and a larger volume second cylinder 120. A compression piston 122 is positioned for reciprocal motion in the first cylinder 114. A first exhaust piston 124 is positioned within the second cylinder 116 for reciprocating motion therein. An expansion piston 128 is positioned for reciprocal motion in the first cylinder 118 of the expansion stage 112 and a second exhaust piston 126 is positioned in the second cylinder 120 of the expansion stage 112. Guide rods 130 are attached to each of the pistons and connected to a crankshaft (not shown) by suitable linking elements. The crankshaft, in turn, is connected to a flywheel (not shown), which is connected to a motor or other mechanical energy device. Preferably, the compression piston 122 operates approximately 180° out of phase with the first exhaust piston 124 and the expansion piston 128 operates approximately 180° out of phase with the second exhaust piston 126.

A first connecting conduit 132 connects the first cylinder 114 and the second cylinder 116 to allow the working medium to pass therebetween. Likewise, a second connecting conduit 134 connects the first cylinder 118 and the second cylinder 120 of the expansion stage. As illustrated in FIG. 6, each of the connecting conduits 132, 134 includes suitable valves 136 for controlling fluid flow therethrough.

During the step of substantial adiabatic compression, the working medium is displaced through the first connecting conduit 132 from the first cylinder 114 to the smaller volume second cylinder 116 of the compression stage by the compression piston 122. During the step of substantially adiabatic expansion, the working medium is displaced through the second connecting conduit 134 from the first cylinder 118 to the larger volume second cylinder 120 of the expansion stage by the expansion piston 128.

A first heat exchanger conduit 138 connects the second cylinder 116 of the compression stage and the first cylinder 118 of the expansion stage. A first heat exchanger 140 is positioned about the first heat exchanger conduit 138 proximate second cylinder 116. The first heat exchanger 140 includes a fluid input 144 and a fluid output 142 for connection to a hot reservoir. A heat transfer medium is circulated through the first heat exchanger 140 and the hot reservoir. The first heat exchanger 140 provides for heat transfer between the working medium passing through the first heat exchanger conduit 138 and the heat transfer medium circulating through the first heat exchanger 140.

A second heat exchanger conduit 150 connects between the second cylinder 120 of the expansion stage 112 and the first cylinder 114 of the compression stage 110. A second heat exchanger 152 is positioned about the second heat exchanger conduit proximate second cylinder 120 and is coupled through input 154 and output 156 to a cold reservoir. A heat transfer medium is circulated through the second heat exchanger 152 and the cold reservoir. The second heat exchanger 152 provides for heat transfer between the working medium within the second heat exchanger conduit 150 and the heat transfer medium circulating through the second heat exchanger 152. As illustrated in FIG. 5, the first heat exchanger conduit 138 and the second heat exchanger conduit 150 include suitable valves 158 for controlling fluid flow therethrough.

The thermodynamic system 10 in accordance with the second embodiment can also include a recuperative heat exchanger system. A first recuperative heat exchanger section 160*a* is positioned about the first heat exchanger conduit 138 proximate the first cylinder 118 of the expansion stage 112 and a second recuperative heat exchanger section 160*b* is provided about the second heat exchanger conduit 150 proximate the first cylinder 114 of the compression stage 110. A heat transfer medium is circulated between the first recuperative heat exchanger section 160*a* and the second recuperative heat exchanger section 160*b*. The input 164 of the first recuperative heat exchanger section 160*a* is connected to the output 166 of the second recuperative heat exchanger section 160*b* and the output 162 of the first recuperative heat exchanger section 160*a* is connected to the input 168 of the second recuperative heat exchanger section 160*b*. The recuperative heat exchange system provides for efficient heat transfer between the working medium in the first heat exchanger conduit 138 and the working medium in the second heat exchanger conduit 150, in a manner analogous to that described above.

During the steps of constant volume heat transfer, the working medium is displaced at constant volume through the first heat exchanging conduit 138 from the second cylinder 116 of the compression stage into the first cylinder 118 of the expansion stage by the exhaust piston 124 and the expansion piston 128. Accordingly, the volume of the second cylinder 116 of the compression stage is substantially equal to the volume of the first cylinder 118 of the expansion stage. Likewise, the working medium is displaced at constant volume through the second heat exchanging conduit 150 from the second cylinder 120 of the expansion stage and into the first cylinder 114 of the compression stage. Accordingly, the volume of the second cylinder 120 of the expansion stage is substantially equal to the volume of the first cylinder 114 of the compression stage.

The thermodynamic system in accordance with the second embodiment of the invention operates according to the thermodynamic cycle illustrated in FIGS. 4 and 5 and described above. As illustrated in FIGS. 5 and 6, the thermodynamic system 10 is best suited for operation as a heat pump or refrigeration system. When operated as a heat engine, it is preferable that the position of the first heat exchanger 140 and first recuperative heat exchanger section 160*a* be reversed. It is also preferable for the position of the second heat exchanger 152 and the second recuperative heat exchanger section 160*b* be reversed during the heat engine mode of operation. In this manner, the efficiency of the thermodynamic system can be maximized.

The thermodynamic system according to the second embodiment of the invention can also include an auxiliary pressurizing system 190 coupled to the first and second heat exchanging conduits 138 and 150. The auxiliary pressurizing system can include two pressure regulating units 190*a* and 190*b*, such as a conventional pump or compressor. The pressure regulating unit 190*a* operates to pressurize the first heat exchanging conduit 138 to an operating density substantially equal to the pressure of the working medium after the step of substantially adiabatic compression. Likewise, the pressure regulating unit 190*b* operates to pressurize the second heat exchanging conduit 150 to an operating density substantially equal to the density of the working medium after the step of substantially adiabatic expansion.

One skilled in the art will recognize that the rate of output, whether positive work by an engine or heat transfer by a heat pump or refrigeration device, can be readily controlled by increasing or decreasing the mass of the working medium in the system. For this purpose, either pressure regulating unit 190*a* or 190*b* can be coupled to a reservoir of working medium from which the working medium can be added to the system or withdrawn from the system during operation.

While the thermodynamic system of the present invention has been illustrated and described as a closed-loop system, one skilled in the art will recognize that the system can also operate as an open system in which the working medium is input from and output to an external source.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be the to fall therebetween.

Having described the invention, what is claimed as new and desired to be secured by Letters Patent is:

1. A thermodynamic system having a working medium, the system comprising a compression stage for substantially adiabatically compressing the medium to raise the temperature of the medium, an expansion stage for substantially adiabatically expanding the medium to decrease the temperature of the medium, first heat exchange means coupling the compression stage and the expansion stage to allow the expanded medium to pass therebetween, the first heat exchange means being configured to transfer heat substantially isochoricly between the cold reservoir and the expanded medium, and second heat exchange means coupling the compression stage and the expansion stage to allow the compressed medium to pass therebetween, the second heat exchange means being configured to transfer heat substantially isochoricly between the compressed medium and the hot reservoir.

2. The thermodynamic system according to claim 1, wherein the thermodynamic system is structured to form a refrigerator for transferring heat from a cold reservoir to a hot reservoir to cool the cold reservoir.

3. The thermodynamic system according to claim 2, wherein the first heat exchange means is structured to transfer heat substantially isochoricly from the cold reservoir to the expanded medium to cool the cold reservoir, and the second heat exchange means is structured to transfer heat substantially isochoricly from the compressed medium to the hot reservoir to cool the medium.

4. The thermodynamic system according to claim 1, wherein the thermodynamic system is structured to form a heat pump for transferring heat from a cold reservoir to a hot reservoir to heat the hot reservoir.

5. The thermodynamic system according to claim 4, wherein the first heat exchange means is structured to transfer heat substantially isochoricly from the cold reservoir to the expanded medium to heat the expanded medium and the second heat exchange means is structured to transfer heat substantially isochoricly from the compressed medium to the hot reservoir to heat the hot reservoir.

6. The thermodynamic system according to claim 1, wherein the thermodynamic system is structured to form a heat engine for converting heat from a hot reservoir to mechanical energy.

7. The thermodynamic system according to claim 6, wherein the first heat exchange means is structured to transfer heat substantially isochoricly from the expanded medium to a cold reservoir to cool the expanded medium, and the second heat exchange means is structured to transfer heat substantially isochoricly from the hot reservoir to the compressed medium to further heat the compressed medium, whereby expansion of the compressed medium produces mechanical energy.

8. The thermodynamic system according to claim 1, wherein the compression stage comprises a first cylinder having a first volume, a second cylinder having a second volume less than the first volume, and displacement means for displacing the medium from the first cylinder to the second cylinder to compress the medium substantially adiabatically.

9. The thermodynamic system according to claim 1, wherein the expansion stage comprises a first cylinder having a first volume, a second cylinder having a second volume greater than the first volume, and displacement means for displacing the medium from the first cylinder to the second cylinder to expand the medium substantially adiabatically.

10. The thermodynamic system according to claim 1, further comprising an auxiliary pressurizing means connected to the second heat exchange means, the auxiliary pressurizing means pressurizing the second heat exchange means to a preferred operating working medium density prior to passage of the compressed medium through the second heat exchange means.

11. The thermodynamic system according to claim 10, wherein the preferred operating density is substantially equal to the density of the compressed medium entering the second heat exchange means from the compression stage.

12. The thermodynamic system according to claim 1, further comprising an auxiliary pressurizing means connected to the first heat exchange means, the auxiliary pressurizing means pressurizing the first heat exchange means to a preferred operating working medium density prior to passage of the expanded medium through the first heat exchange means.

13. The thermodynamic system according to claim 12, wherein the preferred operating density is substantially equal to the density of the compressed medium entering the first heat exchange means from the expansion stage.

14. The thermodynamic system according to claim 1, further comprising a recuperative heat exchange means for transferring heat between the expanded medium within the first heat exchange means and the compressed medium within the second heat exchange means.

15. The thermodynamic system according to claim 14, wherein the recuperative heat exchange means comprises a first recuperative heat exchanging conduit connecting said first heat exchange means and said second heat exchange means to transfer heat substantially isochoricly between said expanded medium and said compressed medium, and a second recuperative heat exchanging conduit connecting said first heat exchange means and said second heat exchange means to transfer heat substantially isochoricly between said expanded medium and said compressed medium.

16. A thermodynamic system having a working medium, the system comprising a first chamber defining a first volume, a second chamber defining a second volume less than the first volume, a first piston operatively positioned with the first chamber for displacing the medium from the first volume to the second volume to compress the medium substantially adiabatically, a second piston operatively positioned within the second chamber for displacing the medium from the second volume to the first volume to expand the medium substantially adiabatically, a first heat exchanger coupled to the second chamber for substantially isochoricly transferring heat between a hot reservoir and the medium after compression by the first piston, and a second heat exchanger coupled to the first chamber for substantially isochoricly transferring heat between a cold reservoir and said medium after expansion by the second piston.

17. The thermodynamic system according to claim 16, wherein the thermodynamic system is structured to form a refrigerator for transferring heat from the cold reservoir to the hot reservoir to cool the cold reservoir.

18. The thermodynamic system according to claim 17, wherein the first heat exchanger is structured to transfer heat substantially isochoricly from the cold reservoir to the expanded medium to cool the cold reservoir, and the second heat exchange means is structured to transfer heat substantially isochoricly from the compressed medium to the hot reservoir to cool the medium.

19. The thermodynamic system according to claim 16, wherein the thermodynamic system is structured to form a heat pump for transferring heat from the cold reservoir to the hot reservoir to heat the hot reservoir.

20. The thermodynamic system according to claim 19, wherein the first heat exchanger is structured to transfer heat substantially isochoricly from the cold reservoir to the expanded medium to heat the expanded medium and the second heat exchanger is structured to transfer heat substantially isochoricly from the compressed medium to the hot reservoir to heat the hot reservoir.

21. The thermodynamic system according to claim 16, wherein the thermodynamic system is structured to form a heat engine for converting heat from the hot reservoir to mechanical energy.

22. The thermodynamic system according to claim 21, wherein the first heat exchanger is structured to transfer heat substantially isochoricly from the expanded medium to a cold reservoir to further cool the expanded medium, and the second heat exchanger is structured to transfer heat substantially isochoricly from the hot reservoir to the compressed medium to further heat the compressed medium, whereby expansion of said compressed medium produces mechanical energy.

23. The thermodynamic system according to claim 16, further comprising an auxiliary pressurizing means connected to the second heat exchanger, the auxiliary pressurizing means pressurizing the second heat exchanger to a preferred working medium operating density prior to passage of the compressed medium through the second heat exchanger.

24. The thermodynamic system according to claim 23, wherein the preferred working medium operating density is substantially equal to the density of the compressed medium entering the second heat exchanger.

25. The thermodynamic system according to claim 16, further comprising an auxiliary pressurizing means connected to the first heat exchanger, the auxiliary pressurizing means pressurizing the first heat exchanger to a preferred working medium operating density prior to passage of the expanded medium through the first heat exchanger.

26. The thermodynamic system according to claim 25, wherein the preferred working medium operating density is substantially equal to the density of the compressed medium entering the first heat exchange means from the expansion stage.

27. The thermodynamic system according to claim 16, further comprising a recuperative heat exchanger for transferring heat between the expanded medium within the first heat exchanger and the compressed medium within the second heat exchanger.

28. A refrigeration method for transferring heat from a cold reservoir to a hot reservoir to cool the cold reservoir, the method comprising the steps of substantially adiabatically compressing a medium to raise the temperature of the medium, substantially isochoricly transferring heat from the compressed medium to a hot reservoir, substantially adiabatically expanding the medium to decrease the temperature of the medium, and substantially isochoricly transferring heat from the cold reservoir to the expanded medium to cool the cold reservoir.

29. The refrigeration method of claim 28, wherein the step of compressing the medium and the step of expanding the medium occur concurrently.

30. The thermodynamic system according to claim 28, wherein the recuperative heat exchange means comprises a first recuperative heat exchanging conduit connecting said first heat exchanger and said second heat exchanger to transfer heat substantially isochoricly between said expanded medium and said compressed medium, and a second recuperative heat exchanging conduit connecting said first heat exchanger and said second heat exchanger to transfer heat substantially isochoricly between said expanded medium and said compressed medium.

31. A method of transferring heat from a cold reservoir to a hot reservoir to heat the hot reservoir, the method comprising the steps of substantially adiabatically expanding a medium to decrease the temperature of the medium, substantially isochoricly transferring heat from the cold reservoir to the expanded medium, substantially adiabatically compressing the medium to raise the temperature of the medium, and substantially isochoricly transferring heat from the compressed medium to a hot reservoir to heat the hot reservoir.

32. The method of claim 31, wherein the step of compressing the medium and the step of expanding the medium occur concurrently.

33. A method of converting heat from a hot reservoir to mechanical energy, the method comprising the steps of substantially adiabatically expanding a medium to decrease the temperature of the medium, substantially isochoricly transferring heat from the expanded medium to the cold reservoir, substantially adiabatically compressing the medium to raise the temperature of the medium, and substantially isochoricly transferring heat from the hot reservoir to the compressed medium to further heat the medium, whereby expansion of said compressed medium produces mechanical energy.

34. The method of claim 33, wherein the step of compressing the medium and the step of expanding the medium occur concurrently.

* * * * *